United States Patent [19]

Sterner, Jr.

[11] Patent Number: 4,594,813

[45] Date of Patent: Jun. 17, 1986

[54] WINDOW VENT

[75] Inventor: Maurice E. Sterner, Jr., York, Pa.

[73] Assignee: Schlegel Corporation, Rochester, N.Y.

[21] Appl. No.: 121,580

[22] Filed: Feb. 14, 1980

[51] Int. Cl.[4] ..... E05D 13/00

[52] U.S. Cl. ..... 49/450; 49/63; 98/99.01

[58] Field of Search ..... 49/450, 449, 63, 407; 98/97, 99.6, 99.01, 88.1

[56] References Cited

U.S. PATENT DOCUMENTS

| | | | |
|---|---|---|---|
| 1,247,622 | 11/1917 | Berrigan | 49/450 X |
| 4,283,883 | 8/1981 | Sterner, Jr. | 49/194 |
| 4,320,597 | 3/1982 | Sterner, Jr. | 49/449 |

*Primary Examiner*—Philip C. Kannan

*Attorney, Agent, or Firm*—Cushman, Darby & Cushman

[57] ABSTRACT

In a window sash of the kind which in use is vertically movable within a stationary frame, an assembly for holding the sash at an elevated, partially open position in the frame comprising: at least one stop element carried within a downwardly open recess in said sash and mounted in said recess for free sliding movement in the plane of the sash between a retracted position in the recess and an extended position in which a portion of the stop element protrudes out of said recess; and a manually operable latch carried by said sash selectively operable to hold said stop element in its extended position and to release said element for free sliding movement within said recess, whereby raising of said sash in its frame allows said stop element to move to its extended position and whereby said element may then be latched in its extended position.

3 Claims, 6 Drawing Figures

WINDOW VENT

This invention relates to a slidable window sash having means associated therewith for holding the sash in a partially open position. The arrangement is particularly useful in a storm window sash to enable circulation of air within the space between the storm window and the prime window for the purpose of removing condensation from that space.

BACKGROUND AND SUMMARY OF THE INVENTION

It is broadly known to provide latch or fastening structures in or on a sliding window sash for the purpose of holding the sash in any of several partially open positions. Such structures have long been used in windows in railway carriage cars, busses and buildings for the purpose of adjusting the amount of ventilation which the window provides. Examples of such structures are described in U.S. Pat. Nos. 429,669, 2,018,281, 2,547,315 and U.S. Pat. No. Re. 24,077.

With respect to storm windows it has been recognized that the space between a storm window and its prime window occasionally requires venting in order to remove condensation which may have occurred in that space. The present invention is particularly directed to providing for circulation of outside air in that space. It was thought at first that providing a closable vent slot or slots directly through the storm window sash would be a suitable arrangement for effecting the desired air circulation. However, later calculations showed that such an arrangement was not satisfactory for a tightly fitting storm window which permits only very little air to leak from the outside into the space between the storm window and the prime window. Specifically it was shown that the total area of the vent or vents necessary for effective condensation removal was so large that it would require so large a vent or so many small vents as to be impractical. Therefore it was decided to provide venting by arranging for the lower sliding sash to be propped in a partially open position when desired. The prior art window latching or holding devices, such as those described in the aforesaid patents, are not readily incorporated into a sliding storm window sash because they tend to be inaccessible to the operator or to interfere with proper operation or sealing of the sash.

The present invention provides a simple and conveniently operated sash holding device which comprises at least one stop member carried within a downwardly open recess in the lower horizontal sash member and mounted in the recess for free sliding movement in vertical directions. In its down position the stop member protrudes out of the recess to engage the lower window frame member or sill and is latched in that position so as to hold the sash in a partially open position. In its up position the stop member resides in the recess. The mechanism for latching the stop member includes a manually operable member carried by the horizontal sash member.

In the embodiment described more in detail hereinafter the assembly is constructed and arranged such that upon raising the sash the stop member automatically moves to its extended or down position and upon closing the sash the stop member is pushed up into the recess in the sash by engagement of the stop member with the window frame or sill. That is, when the latch member is in its inoperative or "closed" position the stop member is functionally inoperative to hold the sash up, even though the stop member moves. If it is desired to prop the sash in a partially raised position the sash is first raised to at least that position and then the latch member is manually moved to its operative or "open" position to prevent the stop member from moving upwardly.

The latch member thus has only a single latching position, in the sense that it does not latch the stop member in an up position. This feature renders the structure of the assembly of latch member and stop member mechanically simple yet provides the operator with simple and easy control. As the normal position of a lower storm window sash is a down or closed position and as the sash is seldom raised, there is no need to provide for latching the member in its up position. The preferred form of latch member is a horizontally slidable plate or the like fitted into the sash and having a finger hole to receive one or more of the operator's finger tips. It is mechanically and functionally simple to arrange for the plate or the like to have a first or "closed" position in which it does not cooperate with the stop member and a second or "open" position in which it latches the stop member in its down position.

The venting assembly of the present invention, being associated only with the lower horizontal sash member, is particularly useful with a storm window which includes vertically movable sash retainers, because the assembly does not interfere with or require modification of the sash retainers. A storm window of this kind is described in U.S. patent application Ser. No. 109,408 filed Jan. 3, 1980 now U.S. Pat. No. 4,283,883.

DETAILED DESCRIPTION

Figure 1A:
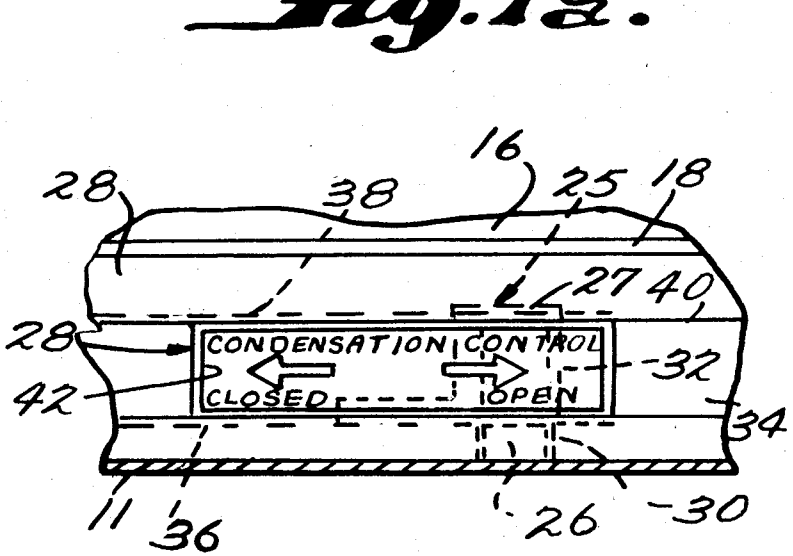
FIGURE 1A is a fragmentary schematic view showing the inside surface of the sash of FIG. 1, taken on the line 1A—1A of FIG. 1.
Figure 2A:
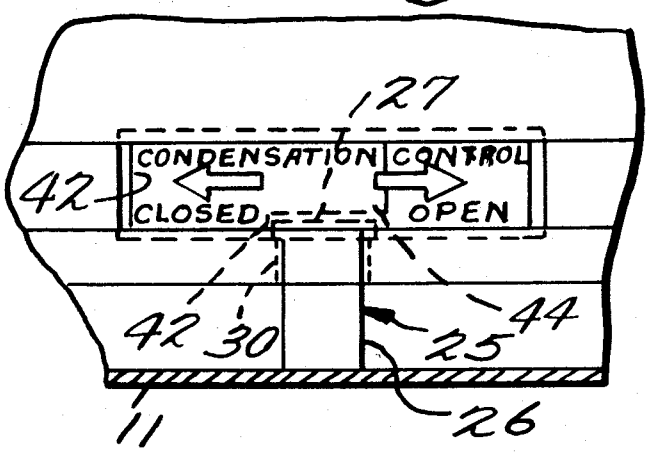
FIG. 2A is a fragmentary schematic view taken on the line 2A—2A of FIG. 2.
Figure 1:
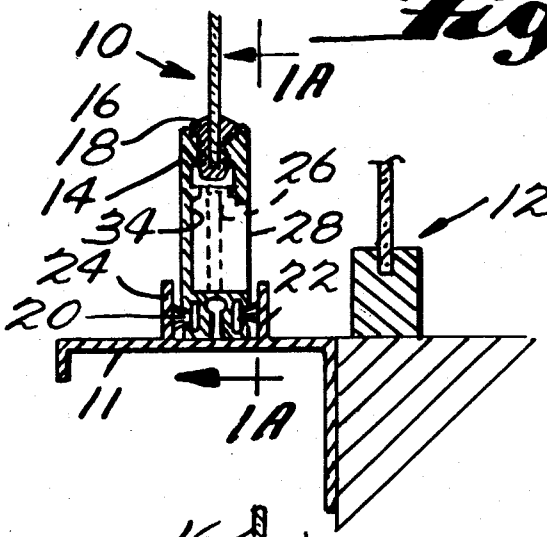
FIG. 1 is a vertical sectional view through the lower portion of the lower sash of a storm window in its closed position.
Figure 2:
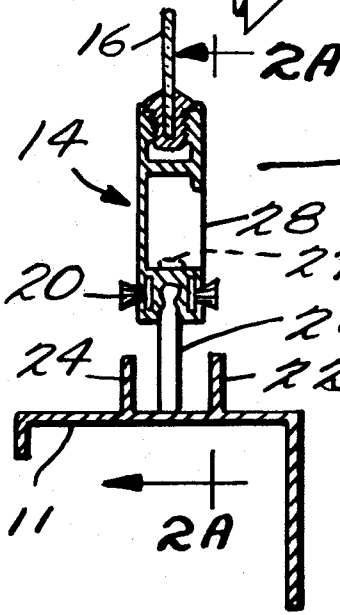
FIG. 2 is a vertical sectional view of the sash of FIG. 1 in a partially open position.
Figure 3:
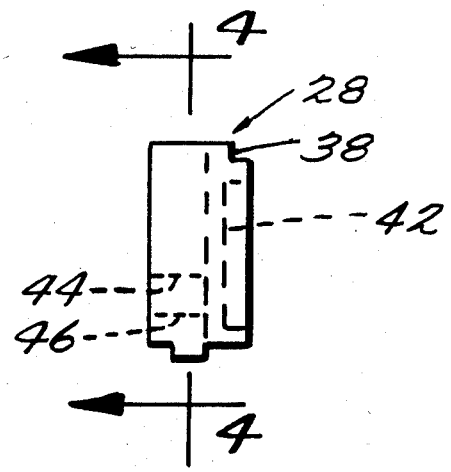
FIG. 3 is an end view, on an enlarged scale, of the latch member shown in FIGS. 1, 1A, 2 and 2A.

FIGS. 1 and 2 illustrate in vertical transverse section a portion of a storm window, specifically a portion of the lower vertically slidable sash 10 of such a window. In FIG. 1 the sash is shown in a closed position, that is in a position in which the lower surface of the sash 10 engages or essentially engages a fixed horizontal sill member 11 attached to the building.

In FIG. 2 the sash 10 is shown held in a partially open position by the vent assembly of the present invention. The left side of the sash 10 as illustrated in these figures faces outwardly and the right side faces inwardly toward a prime window shown schematically at 12.

The sash 10 includes a horizontal sash member 14 made of extruded aluminum alloy and a window pane 16 having its lower edge fitted into a gasket 18 in a groove in the sash member 14. The inside and outside of the sash 10 have horizontal channels therein fitted with strips of weather stripping which may be of the type having a resilient fibrous pile 20 protruding from a base. In the closed position of the sash 10 the pile 20 engages inner and outer upstanding flanges 22 and 24 on the sill 11 to seal against leakage of air.

All of the above features may be conventional in storm window constructions. The present invention is concerned with providing for outside air circulation in the space 23 between the storm window and the prime window 12, by arranging for the sash 10 to be propped in a partially open position when desired. In the illustrated embodiment propping and consequent venting to the outside is accomplished by one or more assemblies each of which includes a vertically movable stop member 25 and an associated latch member 28.

A single venting assembly is illustrated, but it will be understood that more than one may be provided. Usually two such assemblies will be present in horizontally spaced apart locations. As seen in FIGS. 1, 1A, 2 and 2A the illustrated vent assembly is carried by the horizontal sash member 14 so as to be easily accessible to a person within the building, once the lower sash of the prime window 12 has been partially raised. The stop member 25 is a T-shaped plate having a lower body 26 which is freely slidable in vertical directions in a slot 30 in the lower horizontal surface of the sash member 14. The upper portion of the stop member 25, including the bar 27 of the T, is vertically slidable in a slot 32 in the latch member 28 which in turn is slidable in a horizontal channel 34 in the vertical face of the sash member 14. The bar 27 of the T is of greater horizontal dimension than the upper portion of the slot 32 thereby retaining the stop member 25 in the slot 32.

The latch member 28 is slidably retained within the channel 34 by means of two tabs 36 which project downwardly and a shoulder 38 which projects upwardly. The tabs 36 ride in a complementary groove in a wall of the channel 34, and the shoulder 38 rides against a depending lip 40 on the channel wall. A finger grip hole 42 is formed in the front face of the latch member 28.

When the sash 10 is in a closed position the lower surface of the sash member 14 engages or substantially engages the sill 11. In this position of the sash 10, as seen in FIG. 1A, the stop member 25 has engaged the sill and has been pushed upwardly in the slots 30 and 32. Essentially no sliding movement of the latch member 28 can occur at this time because the bar 27 of the stop member 25 resides in the relatively narrow upper portion of the slot 32. As a result no latching of the stop member 25 can be effected.

Figure 4:
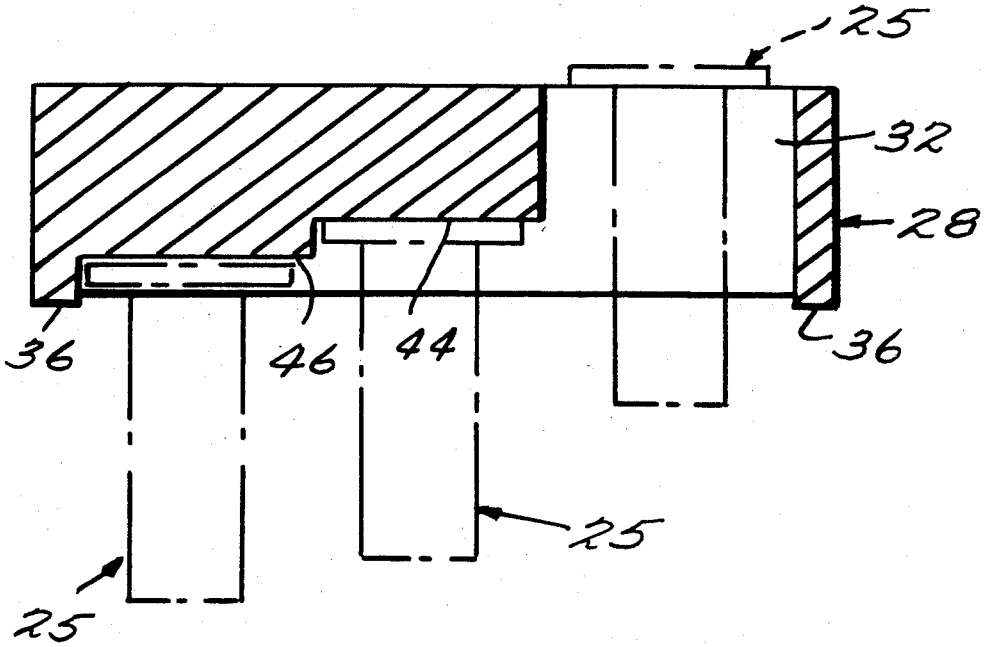
FIG. 4 is a sectional view taken on the line 4—4 of FIG. 3.

If the sash 10 is now raised, the stop member 25 moves down relative to the sash, or more accurately the stop member 25 remains stationary as the sash 10 begins to move upwardly and is then carried upwardly once the bar 27 of the T has become engaged by the top of the slot 30. The latch member 28 can now be slid to the right, over the top of the bar 27 of the T, because of the size and shape of the lower portion of the slot 32 in the latch member. As seen in FIGS. 1A, 2A and 4 the lower portion of the slot 32 is of substantially greater horizontal dimension than the upper portion of the slot 32 and is stepped to provide two shoulders 44 and 46. The two shoulders 44 and 46 allow the stop member 25 to be latched in either of two positions. As shown in FIG. 2A the upper surface of the stop member 25 is in engagement with the shoulder 44. If the sash 10 is raised slightly from this position the latch member can be moved further to the right so that the upper surface of the stop member 25 will engage the shoulder 46, thereby holding the sash at a somewhat higher position and allowing greater circulation of air. FIG. 4 illustrates the three relative positions which the stop member 25 and the latch member 28 can have relative to each other.

The operation of the vent arrangement has been set forth in the above description of the structure. To summarize: FIGS. 1 and 1A illustrate a non-venting, window-closed situation in which the latch member 28 is in its far left position and in which the stop member 25 resides completely within an internal recess in the sash 10, i.e., within the slot 30 in the sash member 14 and the slot 32 in the latch member 28. If the sash 10 is raised, the stop member 25 slides by gravity partially out of the lower end of the slot 30, the maximum protrusion being limited by engagement of the bar 27 of the stop member 25 with the upper edge of the slot 30. With the latch member 28 in its left position the stop member 25 is free to be pushed up into the slots 30 and 32 when the sash 10 is lowered. If, after raising the sash 10 it is desired to prop it in a partially open position, the latch member 28 is slid to the right to position the shoulder 44 or the shoulder 46 over the top of the stop member 25. The stop member 25 is thereby prevented from sliding upwardly and when engaged with the sill 11 will hold the sash 10 partly open. For maximum ventilation, i.e., maximum protrusion of the stop member 25 from the sash 10, the latch member 28 is moved to its far right position to hold the bar 27 almost in contact with the top of the slot 30. For less ventilation the latch member 28 is moved half way to the right, as illustrated in FIG. 2A, with the result that when the sash 10 is lowered the stop member 25 is pushed up into engagement with the shoulder.

What is claimed is:

1. In a window sash of the kind which in use is vertically movable within a stationary frame, an assembly for holding the sash at an elevated, partially open position in the frame comprising: at least one stop element carried within a downwardly open recess in said sash and mounted in said recess for free sliding movement in the plane of the sash between a retracted position in the recess and an extended position in which a portion of the stop element protrudes out of said recess; and a manually operable latch carried by said sash selectively operable to hold said stop element in its extended position and to release said element for free sliding movement within said recess, whereby raising of said sash in its frame allows said stop element to move to its extended position and whereby said element may then be latched in its extended position.

2. Apparatus as in claim 1 wherein said latch is mounted to said sash for horizontal movement between a first position in which part of the latch overlies and engages said stop member to thereby hold said stop member in an extended position and a second position in which said stop member is free to move upwardly to its retracted position.

3. Apparatus as in claim 1 wherein said stop member is a T-shaped plate having a body permanently residing in a recess in the sash and having a bar portion of greater horizontal dimension than said recess residing in a slot in the latch, said latch being mounted above said recess for horizontal movement between first and second positions and said slot having a stepped configuration providing at least one downwardly facing shoulder which, when said latch is in its first position, overlies and engages the top of said stop element to hold the latter in an extended position, said shoulder being offset from said stop element in said second position of said latch so as to permit said stop element to move to its retracted position.

* * * * *